United States Patent [19]

Breitschwerdt

[11] 3,967,511

[45] July 6, 1976

[54] WINDOW LIFTER OF A MOTOR VEHICLE

[75] Inventor: Werner Breitschwerdt, Stuttgart, Germany

[73] Assignee: Daimler-Benz Aktiengesellschaft, Germany

[22] Filed: Sept. 4, 1974

[21] Appl. No.: 502,941

[30] Foreign Application Priority Data

Sept. 6, 1973 Germany ..... 2344862

[52] U.S. Cl. ..... 74/625; 74/545; 74/547; 74/548

[51] Int. Cl.[2] ..... E05F 1/00

[58] Field of Search ..... 74/547, 545, 548, 625; 200/61.85; 49/139

[56] References Cited

UNITED STATES PATENTS

| | | | |
|---|---|---|---|
| 1,274,471 | 8/1918 | Todd | 74/547 X |
| 1,557,073 | 10/1925 | McWhirter | 74/547 X |
| 2,665,904 | 1/1954 | Lehmann | 74/625 |
| 2,693,718 | 11/1954 | Gericke | 74/625 |
| 3,742,781 | 7/1973 | Boyriven | 74/625 |

*Primary Examiner*—Kenneth W. Sprague
*Assistant Examiner*—Harold Joyce
*Attorney, Agent, or Firm*—Craig & Antonelli

[57] ABSTRACT

A window lifter of a motor vehicle actuated by an auxiliary force whose drive is adapted to be engaged electrically; the actuating member for engaging or closing the electric switches for the up and down movement of the window is thereby constructed at the same time as crank arm for the mechanical manual actuation of the window lifter in case of emergency.

14 Claims, 3 Drawing Figures

WINDOW LIFTER OF A MOTOR VEHICLE

The present invention relates to a window lifter in the door or vehicle sidewall of a motor vehicle driven by an auxiliary force, whose drive is adapted to be engaged electrically.

Present-day motor vehicles are occasionally equipped with windowpanes actuatable by an auxiliary force, which are adapted to be moved by an electric motor or by a hydraulic installation. The engagement of the control system for the movement mechanism takes place for the most part electrically.

In case of a failure of the electric current, however, the windows of such actuating installations should be continued to be able of being opened and closed. This is particularly important if the vehicle, as a result of an accident, lands in water and the doors can no longer be opened under water as a result of the water pressure acting on the same. Also in case of a suddenly starting strong rain, it is advantageous if the windows can be still closed mechanically in case of a failure of the electrical actuating system. Customary hand-cranks of mechanically actuated window lifters project into the interior of the motor vehicle and, even if they are made of synthetic material or have soft coverings for reducing accident dangers, are still able to cause injuries in case of an accident. In order to avoid this danger, one has already displaced heretofore door opening handles into a recess of indentation of the vehicle wall so that they no longer project and can no longer contribute to the worsening of an accident occurrence. However, this was not possible heretofore in connection with the cranks of window lifters. It is the aim of the present invention to avoid these disadvantages and to construct mechanically actuated window cranks so as to be less prone to cause accidents while additionally claiming the advantages of the window lifter driven by an auxiliary force. Additionally, with electrically actuated window lifters an emergency actuation is to be provided which is to be as readily accessible as possible for the passenger and which receives a meaningful, stylistically usable arrangement by assuming also additional functions necessary for the normal operation, whereby additional parts for the mechanical actuation are essentially not necessary.

The underlying problems are solved according to the present invention in that an actuating member for the engagement of the electric switches for the up and down movement of the windowpane is constructed simultaneously as crank arm for the manual mechanical actuation of the window lifter in emergency cases. According to a further feature of the present invention, the crank arm which is customarily disposed recessed in a trough or indentation and pivotal thereat toward both sides is able to actuate the one or other electric switch for the up or down movement of the window, is adapted to be tilted or pivoted out of the indentation and when being pivoted out, disconnects or uncouples the driving motor from the rotating pin transmitting the rotary movement and connects itself to this rotary pin. Appropriately, a freely rotatable actuating knob or handle is arranged at the free end of the crank arm which in the folded-in position of the crank arm shifts the one or the other of the two switches arranged in the recess or indentation for the up and down movement of the windowpane by pivoting thereof in the one or the other direction. For establishing the connection from the electric motor to the rotary pin transmitting the rotary movement of the window lifter in case of its actuation by electric or hydraulic means, an eccentric may be arranged at the joint of the crank arm which actuates a clutch arranged within the rotary pin. This clutch disconnects the connection of the electric motor or of the hydraulic drive with the rotary pin, when the window lifter is to be actuated mechanically in case of current failure, and couples the crank arm itself with the rotary pin so that the rotay pin can then be set into rotation by the rotary movement of the crank arm itself.

In the folded-in position, the crank arm therefore serves as switch actuation for the auxiliary force drive of the window lifter for raising or lowering the window. In the other case, the crank arm can be tilted through 180° in case of need and then serves as crank for the mechanical actuation of the rotary pin and therewith of the window lifter. As to the rest, by reason of the fact that the crank arm can be tilted-in recessed in an indentation, it can be avoided that the crank arm represents an obstacle which in case of an accident may represent dangers and cause injuries.

Accordingly, it is an object of the present invention to provide a window lifter of a motor vehicle which avoids by simple means the aforementioned shortcomings and drawbacks encountered in the prior art.

Another object of the present invention resides in a window lifter for use with an auxiliary force which permits a manual opening or closing of the window in case of emergency or in case of failure of the auxiliary force.

A still further object of the present invention resides in a window lifter arrangement which assures the manual opening and closing of the windows even if the electric control system for the auxiliary drive have been disabled.

Another object of the present invention resides in a window lifter arrangement which is characterized by a greater safety to the passengers, yet can be mechanically actuated in case of emergencies.

Still another object of the present invention resides in a window lifter and control system therefor which is simple in construction and readily accessible to the passenger of the vehicle.

A further object of the present invention resides in a window lifter of the type described above which represents a meaningful arrangement, obviating the need for extra mechanical parts, yet represents a pleasing and utilizable design.

These and further objects, features and advantages of the present invention will become more apparent from the following description when taken in connection with the accompanying drawing which shows, for purposes of illustration only, one embodiment in accordance with the present invention, and wherein.

Figure 1:
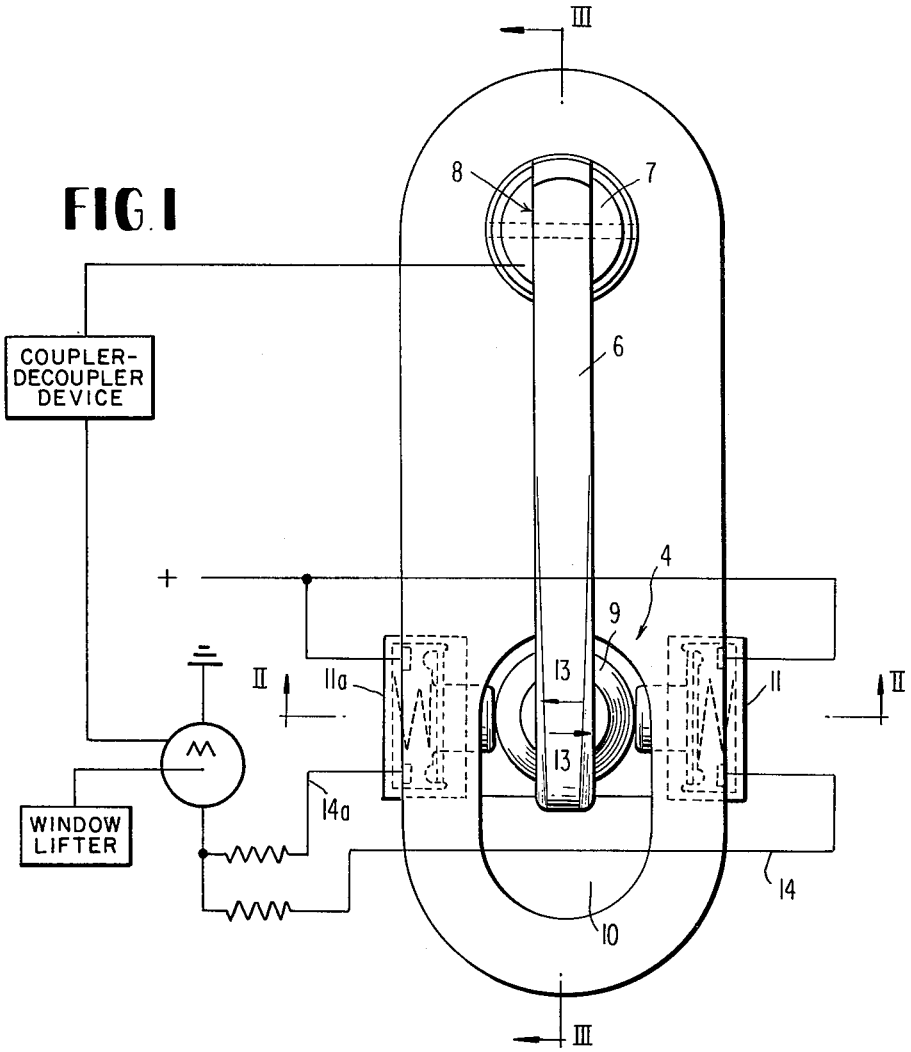
FIG. 1 is a somewhat schematic elevational view on the crank arm folded into the door or vehicle side wall of a window lifter arrangement according to the present invention.

Referring now to the drawing wherein like reference numerals are used throughout the various views to designate like parts, for opening or closing the windowpane of a motor vehicle, a conventional window lifter (FIG. 1) which is driven by an auxiliary force is provided in the vehicle. The window lifter can be driven electrically by an electric motor or hydraulically by a hydraulic motor. Both the electric and hydraulic motor are controlled by a switching installation with two switches and a reversible motor which is not illustrated in detail in the drawing since it is of conventional construction. This reversing motor may produce with the purely electrical construction the entire movement of the window whereas with the hydraulic construction it serves exclusively the purpose to shift a valve.

Figure 2:
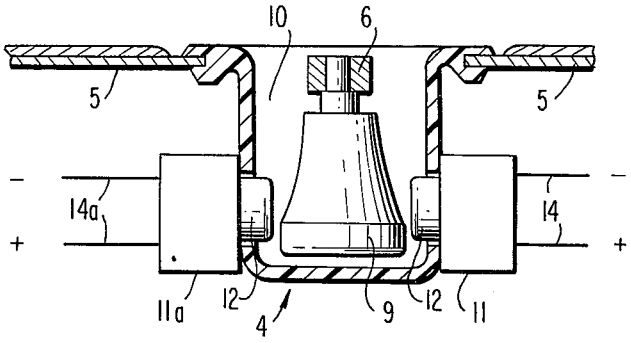
FIG. 2 is a cross sectional view taken along line II—II of FIG. 1.
Figure 3:
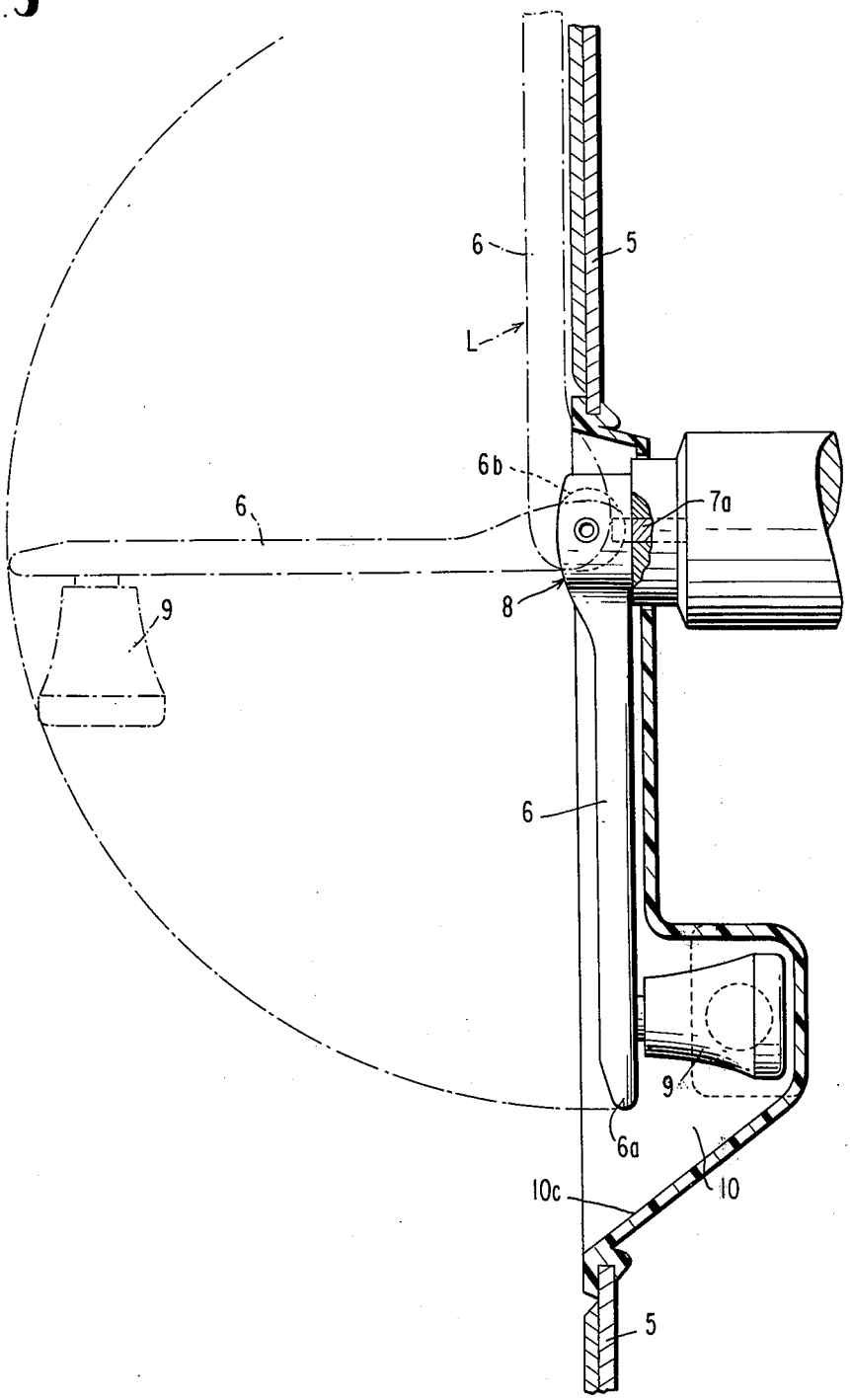
FIG. 3 is a partial cross-sectional view taken along line III—III of FIG. 1.

The switch generally designated by reference numeral 4 which serves for the engagement or energization of the motor M in the desired direction of rotation is arranged at the fixed door inner wall 5 (FIGS. 2 and 3). A crank arm 6 serves as contact-maker which is preferably arranged horizontally in an also horizontally extending recess or indentation in order that the up and down movements of the window are initiated analogously by movements of the switch in the upward or downward direction. The crank arm 6 is so pivotally connected at the rotary pin 7 of the window lifter by means of a fork-joint generally designated by reference numeral 8 that it can be pivoted out of the position illustrated in full lines in FIG. 3 through 180° into the position L indicated in dash and dot lines. In the position of the crank arm 6 illustrated in FIG. 3 in full lines, its actuating knob or button 9 projects into a recess or indentation 10. The latter is so constructed that sufficient space remains between its wall 10*c* and the free end of the crank arm 6*a* to enable the insertion of a finger which is to engage the crank arm from below for its pivoting movement.

One contact switch 11, 11*a* each is arranged on each side of the actuating knob or button 9; one push-button 12 each of the switches 11, 11*a* projects toward the actuating button or knob 9 with a slight spacing. The contact switches 11 and 11*a* are connected each with an energizing circuit 14 and 14*a* of a reversing motor M. If the crank arm 6 is pressed in one direction of the two arrows 13 (FIG. 1) either upwardly or downwardly, then the one or the other energizing circuit of the reversing motor M is closed and the latter is set into rotation in the one or the other direction so that the window is opened or closed.

In case of failure of the electric power supply, the window lifter can be actuated mechanically in that the crank arm 6 is rotated and as a result thereof, the window is opened or closed depending on the direction of rotation. For this purpose, the following structural measures have been taken:

The fork joint 8 is so arranged that the crank arm 6, as already mentioned, can be pivoted out of the position illustrated in FIG. 3 in full lines into the position L illustrated in dash and dot lines. With a circular movement by means of the actuating button or knob 9, the crank arm 6 rotates the rotary pin 7 in the same direction whereby the window lifter raises or lowers the windowpane.

The joint end of the crank arm 6 is provided with an eccentric 6*b* (FIG. 3). The latter, in the position illustrated in FIG. 3 in full lines, presses the center pin 7*a* movable in the axial direction of the rotary pin 7 into the position illustrated in the drawing. In this position of the center pin 7*a*, the crank arm 6 is uncoupled from the rotary pin 7 and the latter, on the other hand, is coupled to the electric motor (FIG. 1) for the electric actuation of the window lifter. In the position of the crank arm 6 pivoted through 180°, i.e., in the position L, the center pin 7*a* protrudes or extends out of the rotary pin 7, and thereby disconnects or uncouples the rotary pin 7 from the electric motor (FIG. 1). Simultaneously therewith, the crank arm 6 is coupled to the rotary pin 7.

This type of window lifter may be applied, of course, not only to door windows but also to all other windows present in motor vehicles.

While I have shown and described only one embodiment in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A window lifter for vehicle windows comprising window lifter means for moving a window of a vehicle in respective up and down directions;

drive means including a drive motor operatively connected to said window lifter means for driving said window lifter means in said directions;

electrical control means including switch means for controlling operation of said drive means; and actuating means including an actuating member being engageable with said switch means of said electric control means for actuating operation of said drive means to effect said up and down movement of said window by said window lifter means, said actuating means including crank arm means for manually and mechanically actuating said window lifter means in an emergency.

2. A window lifter according to claim 1, wherein said crank arm means is disposed in a recessed position within an indentation, said crank arm means being movable within said indentation to engage said switch means.

3. A window lifter according to claim 2, wherein said crank arm means is operable to be pivoted out of the indentation and includes further means for uncoupling said drive motor from a rotary pin transmitting the rotary movement and for connecting itself to said rotary pin means, when being pivoted out.

4. A window lifter according to claim 3, wherein said actuating member includes a knob means arranged at the free end of the crank arm means which in the recessed position of the crank arm means is operable to shift the one or the other of the switch means by being moved in the one or the other direction.

5. A window lifter according to claim 4, wherein said switch means are arranged in the indentation.

6. A window lifter according to claim 5, wherein said knob means is freely rotatable.

7. A window lifter according to claim 6, wherein said crank arm means includes a joint means enabling its pivotal movement, and in that said further means for uncoupling includes an eccentric means arranged at the joint means and a clutch means arranged in the rotary pin means.

8. A window lifter according to claim 1, wherein said actuating member includes a knob means arranged at the free end of the crank arm means which in a recessed position of the crank arm means is operable to shift the one or the other of the switch means by being moved in the one or the other direction.

9. A window lifter according to claim 8, wherein said switch means are arranged in the indentation.

10. A window lifter according to claim 8, wherein said knob means is freely rotatable.

11. A window lifter according to claim 1, wherein said crank arm means includes a joint means enabling its pivotal movement, and an eccentric means arranged at the joint means for actuating a clutch means arranged in the rotary pin means.

12. A Window lifter according to claim 1, wherein said switch means includes two switch members, each of said two switch members actuating said drive means for one of said respective up and down directions.

13. A window lifter according to claim 12, wherein said actuating member includes a knob means arranged at the free end of said crank arm means for actuating one of said two switch members upon movement of said crank arm means.

14. A window lifter according to claim 1, wherein said crank arm means includes means for uncoupling said drive motor from said window lifter means.

* * * * *